US008387179B2

(12) United States Patent
Metz et al.

(10) Patent No.: US 8,387,179 B2
(45) **Date of Patent: *Mar. 5, 2013**

(54) SIDERAIL MECHANISM

(75) Inventors: Darrell L. Metz, Batesville, IN (US); David W. Hornbach, Brookville, IN (US); Terry J. Stratman, Villa Hills, KY (US)

(73) Assignee: Hill-Rom Services, Inc., Batesville, IN (US)

( * ) Notice: Subject to any disclaimer, the term of this patent is extended or adjusted under 35 U.S.C. 154(b) by 154 days.

This patent is subject to a terminal disclaimer.

(21) Appl. No.: 12/871,371

(22) Filed: Aug. 30, 2010

(65) Prior Publication Data

US 2012/0047653 A1 Mar. 1, 2012

(51) Int. Cl.
*A47C 21/08* (2006.01)

(52) U.S. Cl. ..... 5/428; 5/425

(58) Field of Classification Search ..... 5/610, 425–430
See application file for complete search history.

(56) References Cited

U.S. PATENT DOCUMENTS

| | | | | |
|---|---|---|---|---|
| 5,394,580 | A | 3/1995 | Foster et al. | |
| 5,715,548 | A * | 2/1998 | Weismiller et al. | 5/624 |
| 6,363,552 | B1 * | 4/2002 | Hornbach et al. | 5/425 |
| 6,640,360 | B2 | 11/2003 | Hornbach et al. | |
| 6,658,680 | B2 * | 12/2003 | Osborne et al. | 5/600 |
| 7,257,850 | B1 * | 8/2007 | Tekulve | 5/430 |
| 7,712,166 | B2 * | 5/2010 | Stryker et al. | 5/430 |
| 2005/0144720 | A1 * | 7/2005 | Poulin et al. | 5/425 |
| 2009/0229051 | A1 * | 9/2009 | Heimbrock et al. | 5/430 |

* cited by examiner

*Primary Examiner* — Robert G Santos
*Assistant Examiner* — Richard G Davis
(74) *Attorney, Agent, or Firm* — Jason Penninger

(57) ABSTRACT

A person-support apparatus comprises a frame, a first siderail, and a second siderail. The frame includes a first support section and a second support section. The first support section is configured to pivot between a first support position and a second support position with respect to the second support section. The first siderail is coupled to the first support section and configured to move therewith. The second siderail is coupled to the frame and is configured to move along the frame between a first position and a second position. The second siderail is configured to be positioned adjacent to the second support section in the first position, and adjacent to the first support section and below the first siderail in the second position.

22 Claims, 9 Drawing Sheets

SIDERAIL MECHANISM

BACKGROUND OF THE DISCLOSURE

This disclosure relates generally to a siderail mechanism for a person-support apparatus, such as, a hospital bed. More particularly, but not exclusively, one illustrative embodiment relates to a siderail mechanism that allows the siderail to be moved along a frame between a first position and a second position with respect to the frame Person-support apparatuses can include siderails coupled thereto. The siderails can be configured to move between a deployed position and storage position. While various person-support apparatuses have been developed, there is still room for development. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a person-support apparatus with a frame having a first support section movable with respect to a second support section, a first siderail coupled to the first support section and configured to move therewith, and a second siderail positionable adjacent to the second support section in a first position and adjacent to the first support section below the first siderail in a second position. Another illustrative embodiment can include a person-support apparatus with a frame having a guide coupled thereto and a siderail movably coupled to the guide and configured to move along the guide between a first position adjacent a second section of the frame and a second position adjacent a first section of the frame independent of the movement of the first section. Another illustrative embodiment can include a person-support apparatus with a frame having a guide coupled thereto and a siderail movably coupled to the guide and configured to move along the guide between a first position where the siderail is configured to move between a deployed position and a storage position with respect to the frame and a second position where the siderail can only be in the storage position when adjacent to the first section.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
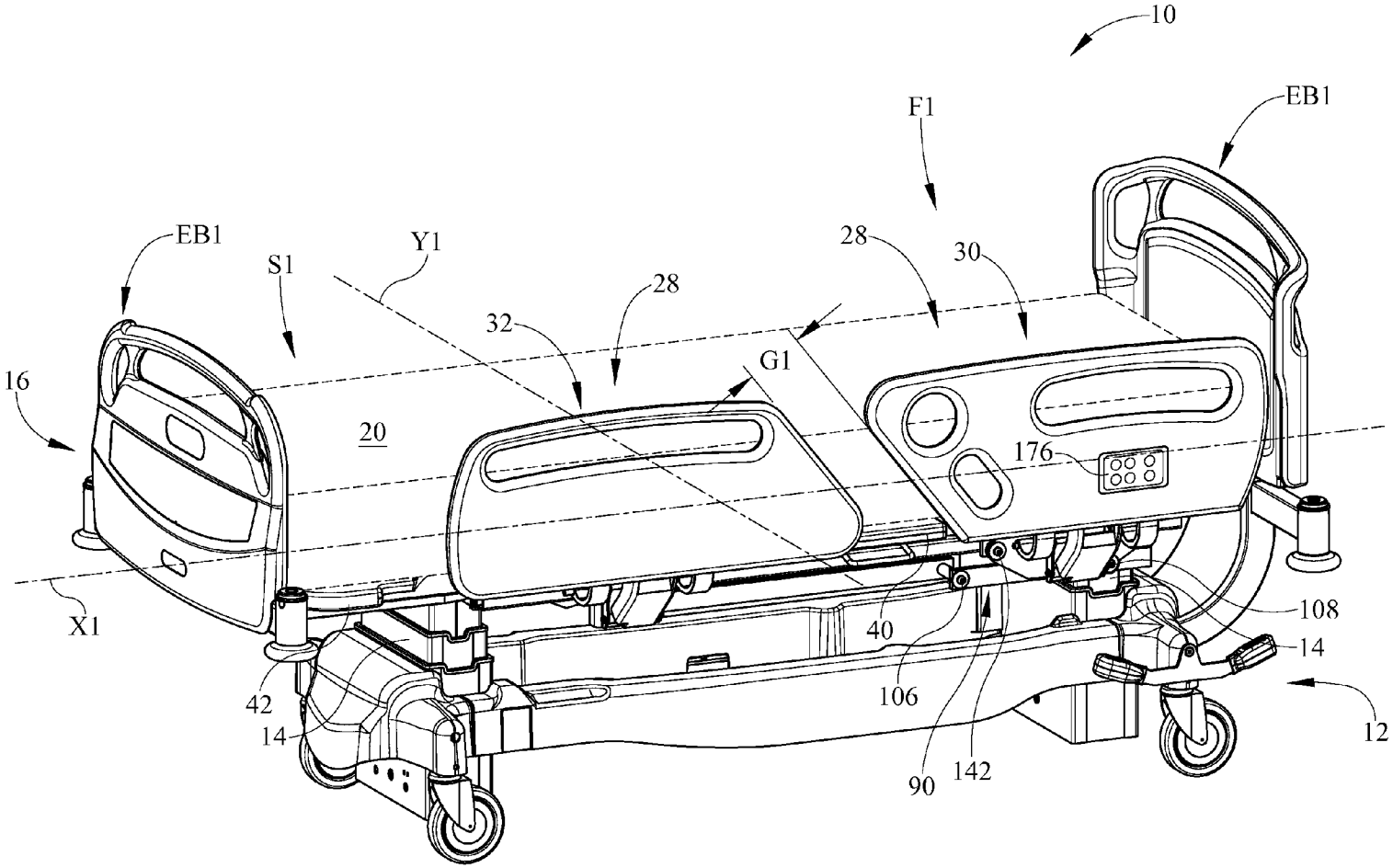
FIG. 1 is a perspective view of person-support apparatus with a headrail assembly and footrail assembly coupled thereto according to an embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a person-support apparatus with a frame having a first support section movable with respect to a second support section, a first siderail coupled to the first support section and configured to move therewith, and a second siderail positionable adjacent to the second support section in a first position and adjacent to the first support section below the first siderail in a second position. Another illustrative embodiment can include a person-support apparatus with a frame having a guide coupled thereto and a siderail movably coupled to the guide and configured to move along the guide between a first position adjacent a second section of the frame and a second position adjacent a first section of the frame independent of the movement of the first section. Another illustrative embodiment can include a person-support apparatus with a frame having a guide coupled thereto and a siderail movably coupled to the guide and configured to move along the guide between a first position where the siderail is configured to move between a deployed position and a storage position with respect to the frame and a second position where the siderail can only be in the storage position when adjacent to the first section.

A person-support apparatus 10 according to one illustrative embodiment of the current disclosure is shown in FIGS. 1-10. The person-support apparatus 10 can be a hospital bed with a first section F1 or head support section F1, where the head of a person (not shown) can be positioned and a second section S1 or a foot support section S1, where the feet of the person (not shown) can be positioned. It should be appreciated that the person-support apparatus 10 can also be a hospital stretcher, an operating table, or other apparatus configured to support a person. The person-support apparatus 10 can define a first longitudinal axis X1 passing through the first section F1 and the second section S1 and a transverse axis Y1 substantially perpendicular to the first longitudinal axis. It should be appreciated that the first longitudinal axis X1 and the transverse axis Y1 can be in the same horizontal plane. The person-support apparatus 10 can include a lower frame 12 or base 12, a plurality of supports 14 coupled with the lower frame 12, an upper frame 16 supported on the supports 14 above the lower frame 12, and a control system 18. It should be appreciated that, in one illustrative embodiment, the person-support apparatus 10 can support a person-support surface 20 or mattress 20 on the upper frame 16. It should also be appreciated that the supports 14 can be lift mechanisms 14 that can move the upper frame 16 with respect to the lower frame 12.

The upper frame 16 can include an upper frame base 22, a deck 24, a movement system 26, a plurality of siderails 28, and endboards EB1 as shown in FIG. 2-10. The plurality of siderails 28 can include a head siderail assembly 30 or headrail assembly 30 and a foot siderail assembly 32 or footrail assembly 32. The upper frame base 22 can be coupled to the supports 14 and can include a first guide 34 and a second guide 36 coupled thereto. The first guide 34 can be coupled to the upper frame base 22 and can extend longitudinally there along. The first guide 34 can be configured to cooperate with the movement system 26 to move a portion of the deck 24 with respect to the upper frame base 22 between a first position and a second position. In one illustrative embodiment, the first guide 34 can be a hollow rectangular tube. It should be appreciated that the first guide 34 can be a C-shaped guide. The second guide 36 can be coupled to the upper frame base 22 and can extend longitudinally there along. The second guide 36 can be configured to cooperate with the foot siderail assembly 32 to move the foot siderail assembly 32 between a first longitudinal position and a second longitudinal position. In one illustrative embodiment, the second guide 36 can be a longitudinally extending rail.

Figure 2:
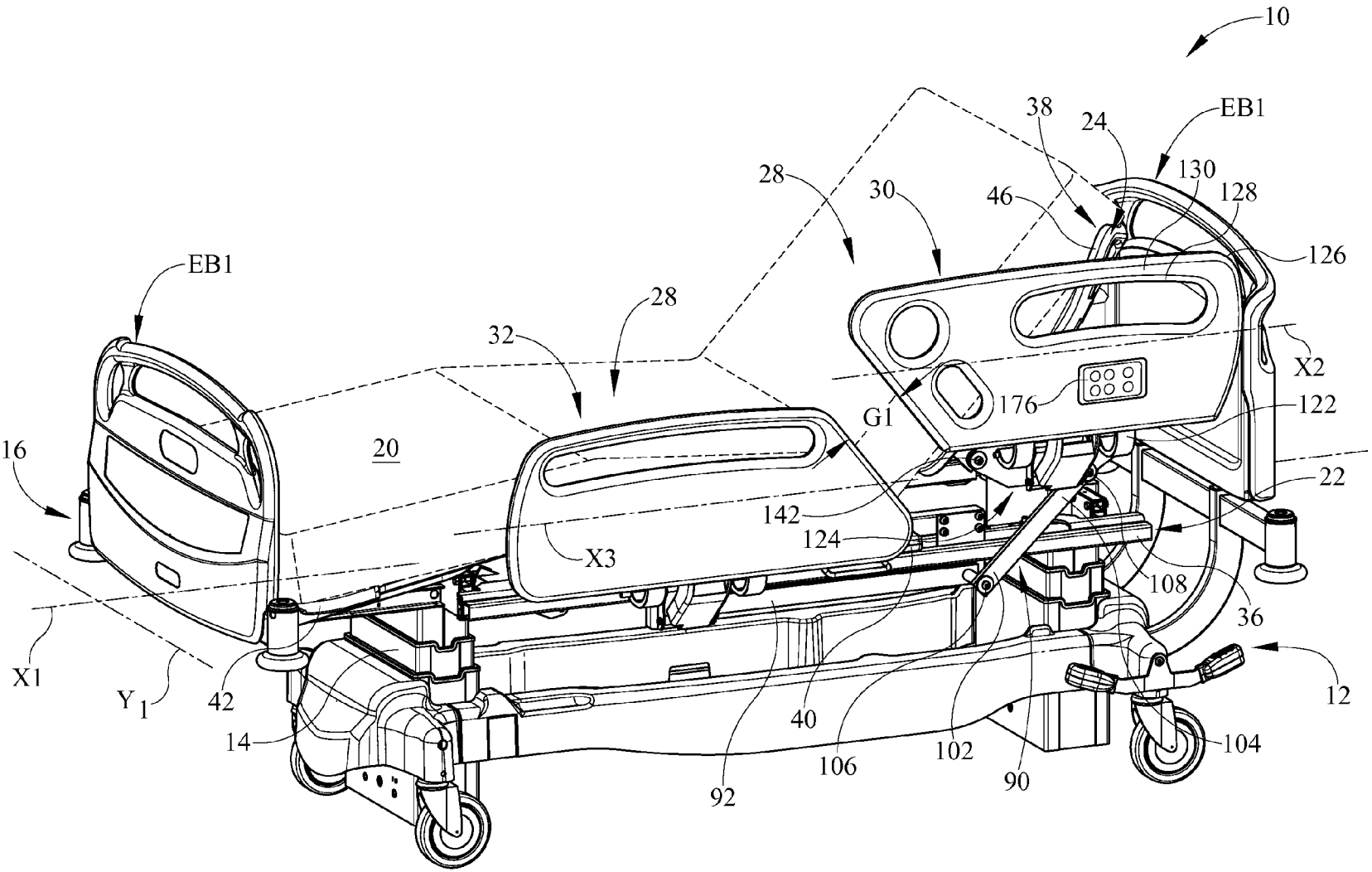
FIG. 2 is a perspective side view of the person-support apparatus of FIG. 1, showing the headrail assembly coupled to the first portion of the deck with the first portion in a second position.
Figure 3:
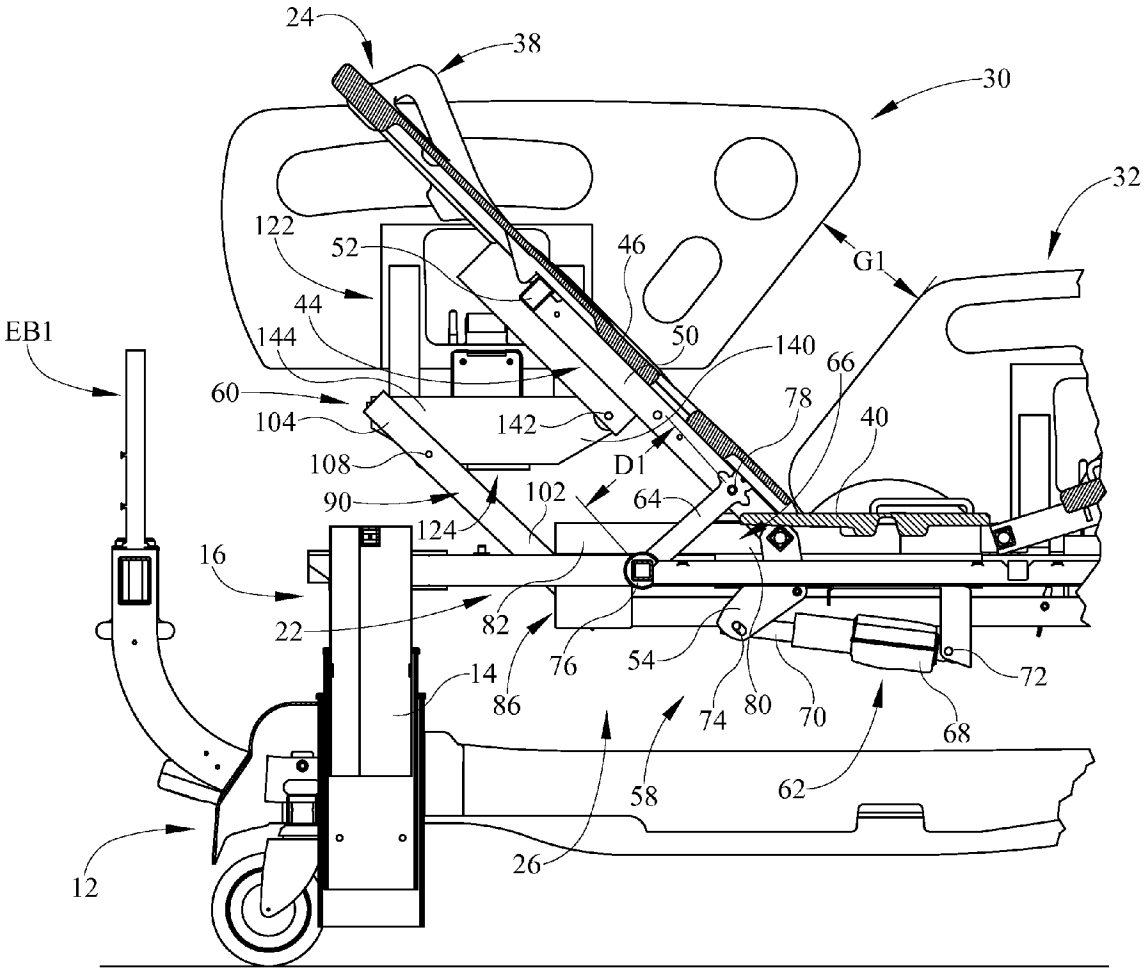
FIG. 3 is a partial sectional side view of the person-support apparatus of FIG. 1, showing the head deck movement assembly.
Figure 4:
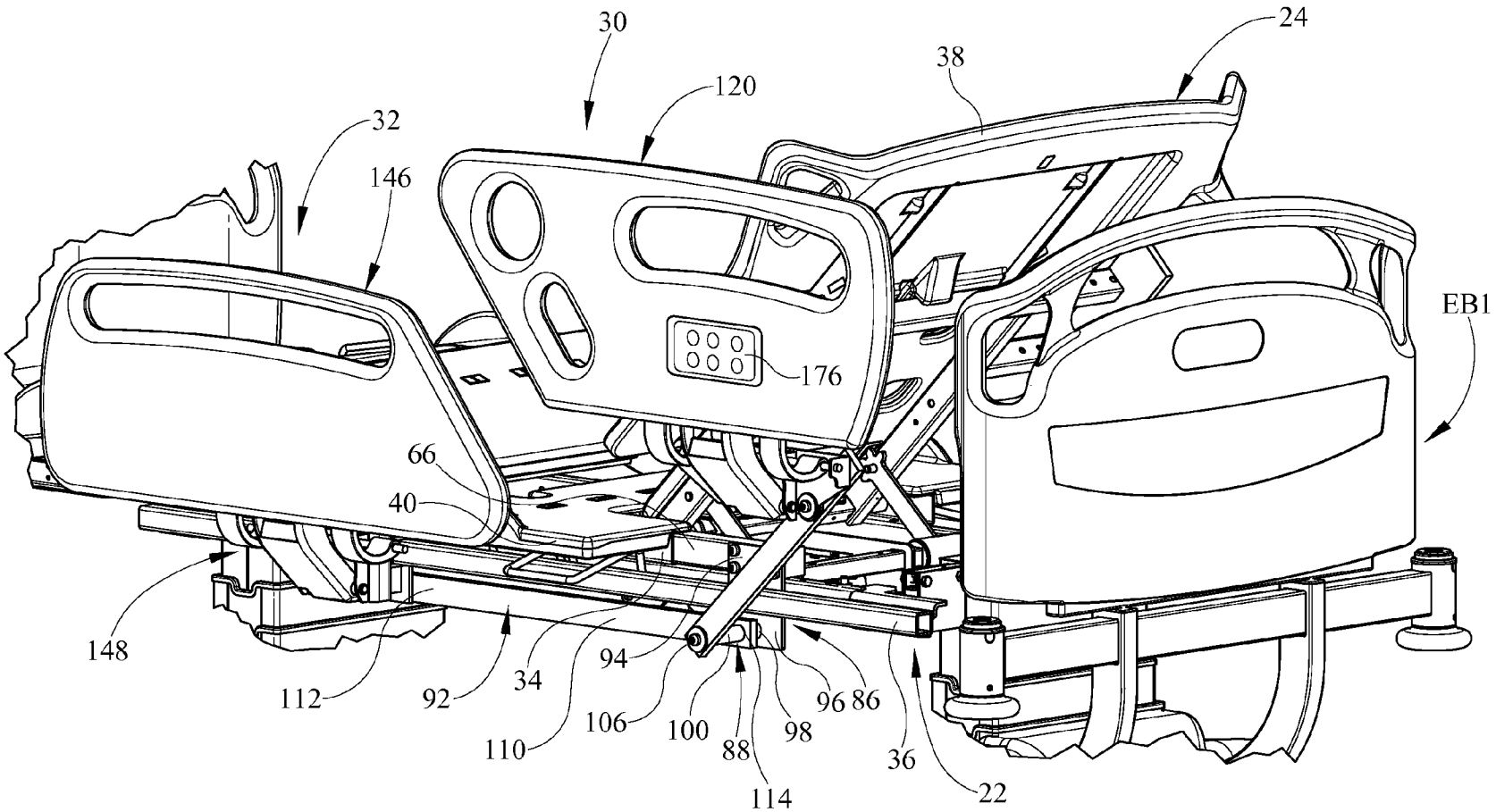
FIG. 4 is a perspective side view of person-support apparatus of FIG. 1 showing the siderail movement assembly cooperating with the first portion to maintain the orientation of the headrail assembly.
Figure 5:
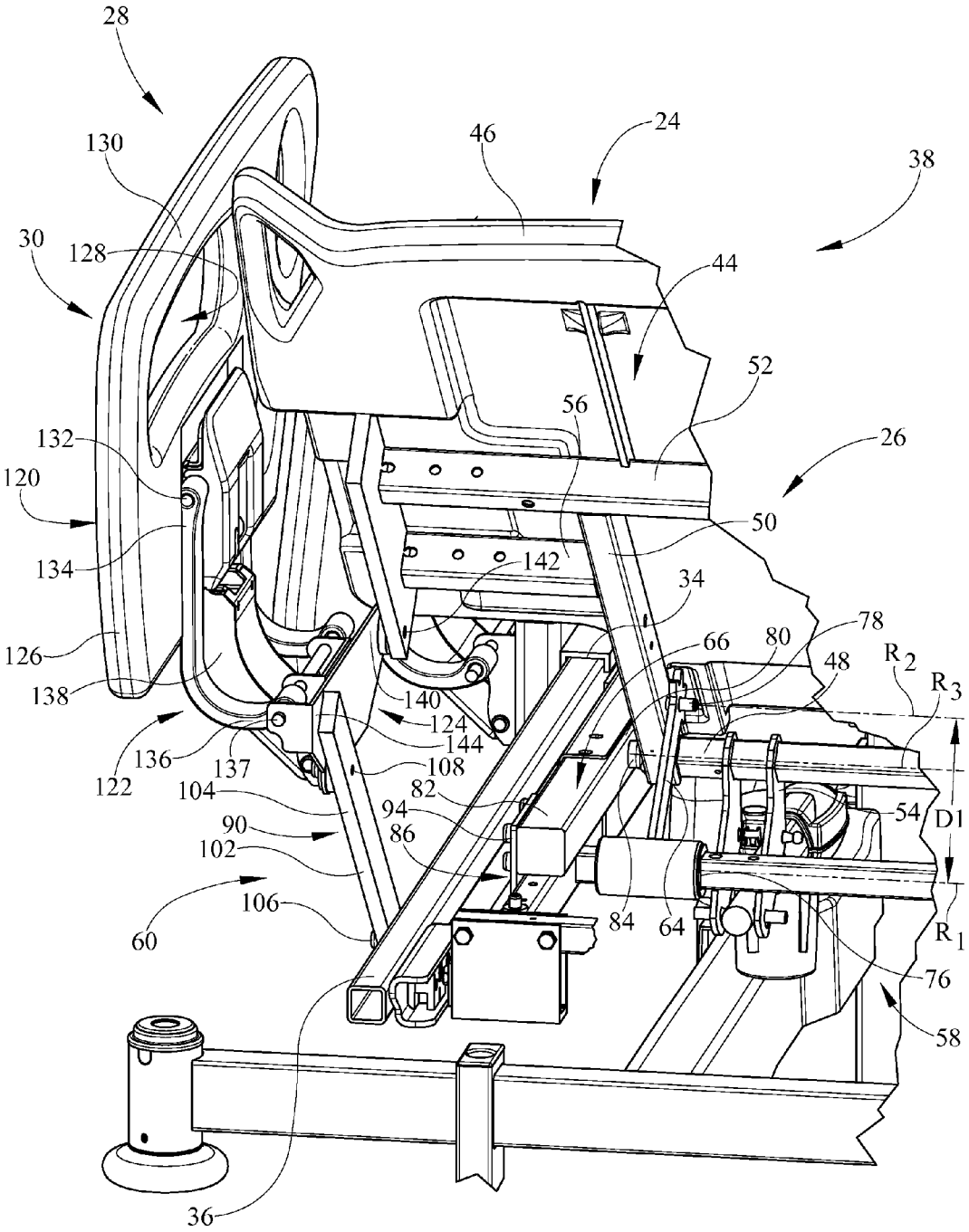
FIG. 5 is a perspective end view of person-support apparatus of FIG. 1 showing the siderail movement assembly cooperating with the first portion and head deck movement assembly to maintain the orientation of the headrail assembly.

The deck 24 can be configured to support a person supported on the person-support apparatus 10 in multiple articulated positions. The deck 24 can include a head portion 38, a seat portion 40, and a foot portion 42 as shown in FIGS. 1 and 2. One or more of the head portion 38, the seat portion 40, and the foot portion 42 can be movably coupled to the upper frame base 22 and the movement system 26. In one illustrative embodiment, the head portion 38 can include a head deck frame 44 and a head deck surface 46 removably coupled to the head deck frame 44. The head deck frame 44 can include a first laterally extending member 48 or base member 48, a plurality of longitudinal members 50, and a second laterally extending member 52 or upper member 52 as shown in FIGS. 3-5. The base member 48 can include a bracket 54 configured to engage the movement system 26. The longitudinal members 50 can be coupled to the base member 48 and the upper member 52 and can cooperate with the base member 48 and the upper member 52 to form a rectangle. It should be appreciated that support members 56 can be coupled to the longitudinal members 50 and can extend therefrom parallel to the upper member 52 to help support the head deck surface 46.

The movement system 26 can be configured to move one or more of the head portion 38, the seat portion 40, and the foot portion 42 with respect to one another and/or the upper frame base 22. The movement system 26 can include a head deck movement assembly 58 and a siderail movement assembly 60 as shown in FIGS. 2-5 and 7-10. It should be appreciated that the movement system 26 can include a seat deck movement assembly (not shown) and a foot deck movement assembly (not shown). The head deck movement assembly 58 and the siderail movement assembly 60 can be coupled together and can cooperate to move the head portion 38 and the headrail assembly 30.

The head deck movement assembly 58 can be configured to move the head portion 38 of the deck 24 between a first head deck position and a second head deck position with respect to the upper frame base 22. In one illustrative embodiment, the head portion 38 of the deck 24 can be substantially parallel with respect to the upper frame base 22 in the first head deck position and at an angle with respect to the upper frame base 22 in the second head deck position. The head deck movement assembly 58 can include an actuator 62, a pair or rotating links 64, and a slide 66. The actuator 62 can include a base 68 and a plunger 70 that can be configured to extend from the base 68 as shown in FIG. 3. The base 68 can be movably coupled to the upper frame base 22 at a first actuator joint 72 and the plunger 70 can be coupled to the bracket 54 coupled to the base member 48 at a second actuator joint 74. In one illustrative embodiment, the actuator 62 can be a linear actuator. It should be appreciated that the actuator 62 can mechanically, electrically, or hydraulically powered. It should also be appreciated that the actuator 62 can be a rotary actuator or other actuator.

The rotating links 64 can be movably coupled to the upper frame base 22 at a first link joint 76 and can be coupled to the longitudinal members 50 at a second link joint 78 as shown in FIGS. 3-5. The rotating links 64 can be configured to rotate about a first rotational axis R1 with respect to the upper frame base 22 and a second rotational axis R2 with respect to the longitudinal members 50 as the actuator 62 moves the base member 48 with respect to the upper frame base 22. The first link joint 76 can be a first distance D1 from the base member 48.

The slide 66 can include a first slide portion 80 coupled to the base member 48 and a second slide portion 82 coupled to the siderail movement assembly 60 as shown in FIGS. 2, 4-5, and 7-10. The first slide portion 80 of the slide 66 can be rotatably coupled to the base member 48 at a first slide joint 84 and can be configured to slidably engage the first guide 34. It should be appreciated that the head deck frame 44 can rotate about a rotational axis R3 passing through the first slide joint 84. The first slide joint 84 can be configured to allow the base member 48 to rotate with respect to the slide 66 as the head portion 38 of the deck 24 moves between the first head deck position and the second head deck position. In one illustrative embodiment, the slide 66 can be rectangularly shaped to fit substantially within the first guide 34. In another illustrative embodiment, the slide 66 can be configured to roll along the first guide 34. It should be appreciated that the slide 66 can include wheels (not shown) or other such rolling mechanisms. The slide 66 can be composed of a plastic or nylon material. It should be appreciated that the slide 66 can be composed of other relatively low friction materials. It should also be appreciated that the slide 66 can also be composed of a relatively higher friction material that can be configured to slide with respect to the first guide 34 when lubricated.

The siderail movement assembly 60 can be configured to move the headrail assembly 30 and/or the footrail assembly 32 in response to the head deck frame 44 moving with respect to the upper frame base 22. In one illustrative embodiment, the siderail movement assembly 60 can be configured to cooperate with the head deck movement assembly 58 to maintain the horizontal orientation of the headrail assembly 30 and move the footrail assembly 32 to maintain a gap G1 between the headrail assembly 30 and the footrail assembly 32 as the head deck frame 44 moves with respect to the upper frame base 22 as shown in FIGS. 1-2 and 7-10.

The siderail movement assembly 60 can be implemented a number of ways. In one illustrative embodiment, the siderail movement assembly 60 can include an actuator (not shown) movably coupled to the upper frame base 22 and movably coupled to a portion of the headrail assembly 30 to move the headrail assembly 30 with respect to the head deck frame 44 as the head deck frame 44 moves with respect to the upper frame base 22. It should be appreciated that the actuator can be movably coupled to the head deck frame 44. It should also be appreciated that the actuator can be controlled by the control system 18 as a function of an input signal generated by an angle sensor (not shown) or inclinometer corresponding to the angle of inclination of the head deck frame 44 with respect to horizontal. In another illustrative embodiment, the siderail movement assembly 60 can include an electric motor (not shown) coupled to the head deck frame 44 and configured to engage a portion of the headrail assembly 30 to move the headrail assembly 30 with respect to the head deck frame 44 as the head deck frame 44 moves with respect to the upper frame base 22. It should be appreciated that a gear reduction technique can be used to move the headrail assembly 30 with the motor. It should also be appreciated that the motor can be controlled by the control system 18 as a function of an input signal generated by an angle sensor (not shown) or inclinometer corresponding to the angle of inclination of the head deck frame 44 with respect to horizontal. In another illustrative embodiment, an actuator, such as, a linear actuator, can be used to move the headrail assembly 30 with respect to the head deck frame 44 as the head deck frame 44 moves with respect to the upper frame base 22.

In another illustrative embodiment, the siderail movement assembly 60 can be implemented using a 4-bar mechanism as shown in FIGS. 2-5 and 7-10. In this embodiment, the siderail movement assembly 60 can include an extension plate 86, an extension member 88, a headrail link 90, and a footrail link 92. It should be appreciated that the siderail movement assembly 60 can not include the extension plate 86 depending on a number of factors, including, but not limited to, the configuration of the upper frame base 22, the position of the first guide 34 and/or second guide 36, the shape of the slide 66, and the way the siderails 28 are coupled to the upper frame 16. The extension plate 86, the extension member 88, and the headrail link 90 can cooperate with the headrail assembly 30, the head deck frame 44, and the slide 66 to form a 4-bar linkage.

The extension plate 86 can include a first plate end 94 that can be configured to be coupled to the second slide portion 82 of the slide 66 and a second plate end 96 that can be configured to be coupled to the extension member 88 as shown in FIGS. 2-5 and 7-10. It should be appreciated that the second slide portion 82 can extend beyond an end of the first guide 34 and can form an L-shape with the extension plate 86 coupled thereto. The extension plate 86 can be configured to help provide clearance for the extension member 88, the headrail link 90, and the footrail link 92 with respect to the first guide 34, second guide 36, and upper frame base 22.

The extension member 88 can include a first extension member end 98 that can be coupled to the second plate end 96 and a second extension member end 100 that can be movably coupled to the headrail link 90 and the footrail link 92 as shown in FIGS. 2-5 and 7-10. The extension member 88 can be configured to extend substantially perpendicularly from the extension plate 86. In one illustrative embodiment, a portion of the extension member 88 can be positioned beneath the second guide 36.

The headrail link 90 can be configured to coordinate movement of the head deck frame 44 and the headrail assembly 30 as shown in FIGS. 2-5 and 7-10. The headrail link 92 can include a first headrail link end 102 and a second headrail link end 104. The first headrail link end 102 can be movably coupled to the extension member 88 at a first headrail link joint 106 and the second headrail link end 104 that can be movably coupled to the headrail assembly 30 at a second headrail link joint 108.

The footrail link 92 can be configured to coordinate movement of the head deck frame 44 and the footrail assembly 32 as shown in FIGS. 2-10. The footrail link 92 can include a first footrail link end 110 and a second footrail link end 112. The first footrail link end 110 can be movably coupled to the extension member 88 at a first footrail link joint 114 and the second footrail link end 112 that can be movably coupled to the footrail assembly 32 at a second footrail link joint 116. In one illustrative embodiment, the second footrail link end 112 can be a hook 118.

The headrail assembly 30 can include a headrail body 120, a headrail linkage 122, and a headrail base 124 as shown in FIGS. 1-5 and 7-10. The headrail body 120 can include a headrail perimeter edge 126 and an headrail opening 128 therethrough that can cooperate with the headrail perimeter edge 126 to define a headrail grip 130. The headrail body 120 can have a second longitudinal axis X2 passing therethrough that can represent the angular orientation of the headrail body 120 with respect to the upper frame 16. In one illustrative embodiment, the second longitudinal axis X2 can be substantially horizontal. In another illustrative embodiment, the second longitudinal axis X2 can be substantially parallel to longitudinal axis X1. In still another illustrative embodiment, the second longitudinal axis X2 can be at an angle with respect to the upper frame 16.

The headrail body 120 can be movably coupled to the headrail linkage 122 and can be configured to selectively move the headrail body 120 between a deployed position or raised position and a storage position or lowered position. The headrail linkage 122 can include a first headrail linkage portion 134 coupled to the headrail body 120 at a first headrail joint 132, a second headrail linkage portion 136 coupled to the headrail base 124 at a second headrail joint 137, and a headrail latch mechanism 138. The headrail linkage 122. The headrail base 124 can include a first headrail base portion 140 movably coupled to the head deck frame 44 at a first base joint 142 and a second headrail base portion 144 movably coupled to the second headrail link end 104 at the first headrail link joint 106.

The footrail assembly 32 can include a footrail body 146, a footrail linkage 148, and a footrail base 150 as shown in FIGS. 1-4 and 6-10. The footrail body 146 can include a footrail perimeter edge 152 and an footrail opening 154 therethrough that can cooperate with the footrail perimeter edge 152 to define a footrail grip 156. The footrail body 146 can have a third longitudinal axis X3 passing therethrough that can represent the angular orientation of the footrail body 146 with respect to the upper frame 16. In one illustrative embodiment, the third longitudinal axis X3 can be substantially horizontal. In another illustrative embodiment, the third longitudinal axis X3 can be substantially parallel to the first longitudinal axis X1.

The footrail body 146 can be movably coupled to the footrail linkage 148 and can be configured to selectively move the footrail body 146 between a deployed position or raised position and a storage position or lowered position. The footrail linkage 148 can include a first foortail linkage portion 160 coupled to the footrail body 146 at a first footrail joint 158, a second foortail linkage portion 162 coupled to the footrail base 150 at a second footrail joint 163, and a footrail latch mechanism 164 as shown in FIG. 6.

Figure 6:
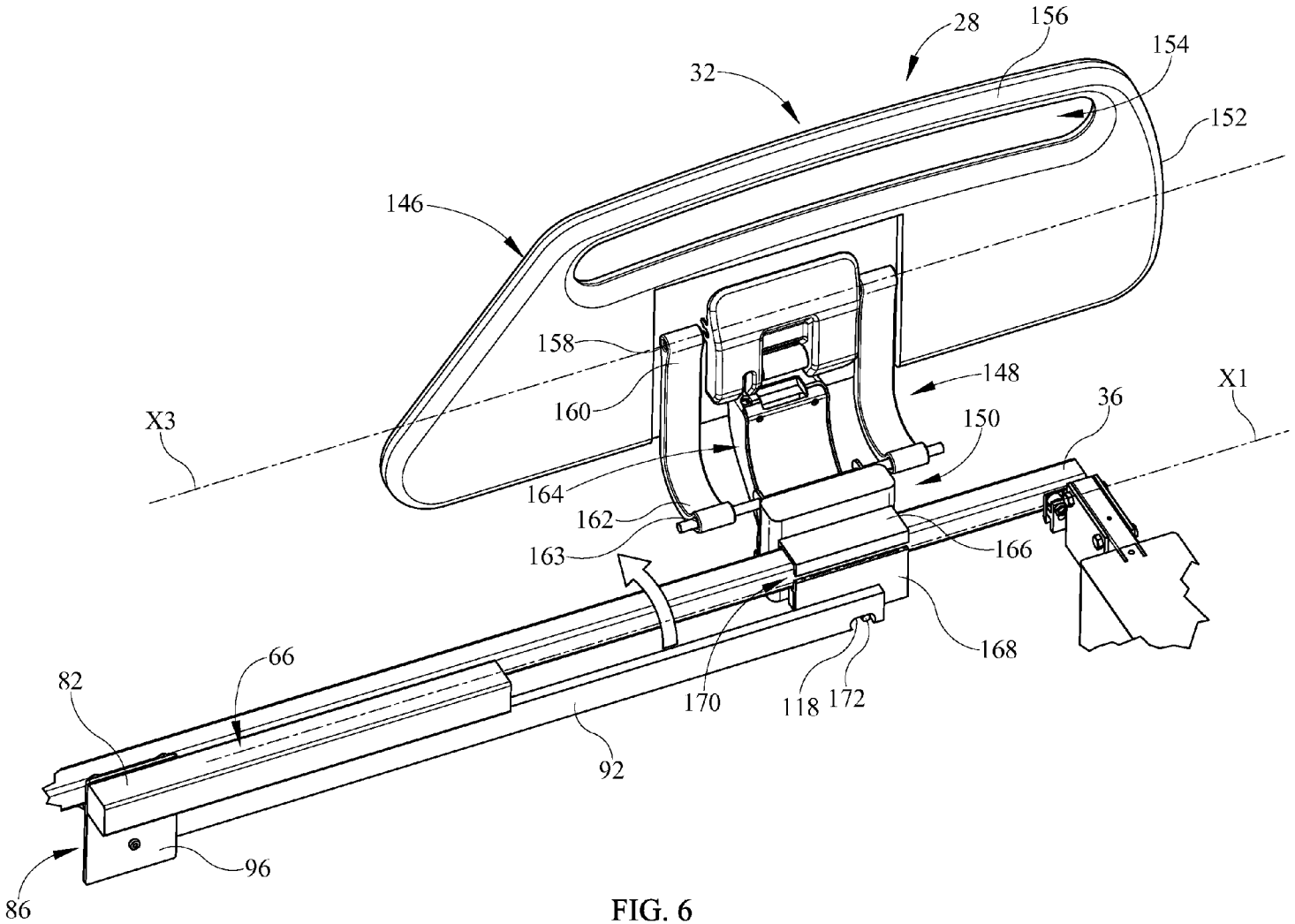
FIG. 6 is a perspective side view of the footrail of FIG. 1 showing the footrail coupled to the guide and the footrail link.
Figure 7:
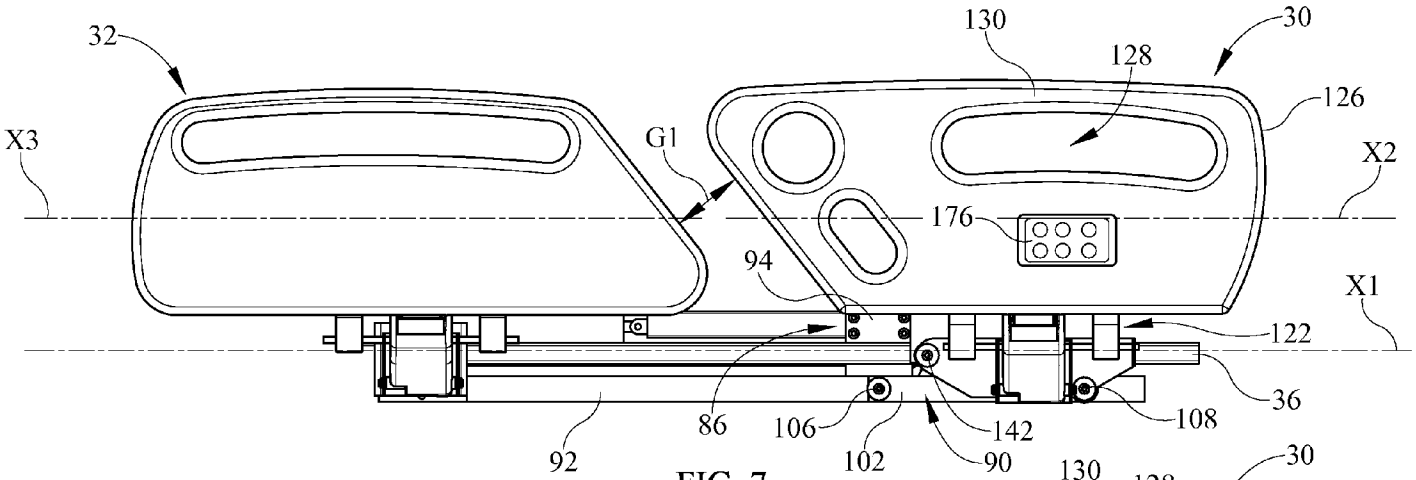
FIG. 7 is a side view of the person-support apparatus of FIG. 1, showing the headrail assembly in a first position with respect to the upper frame cooperating with the footrail assembly to define a space therebetween.
Figure 8:
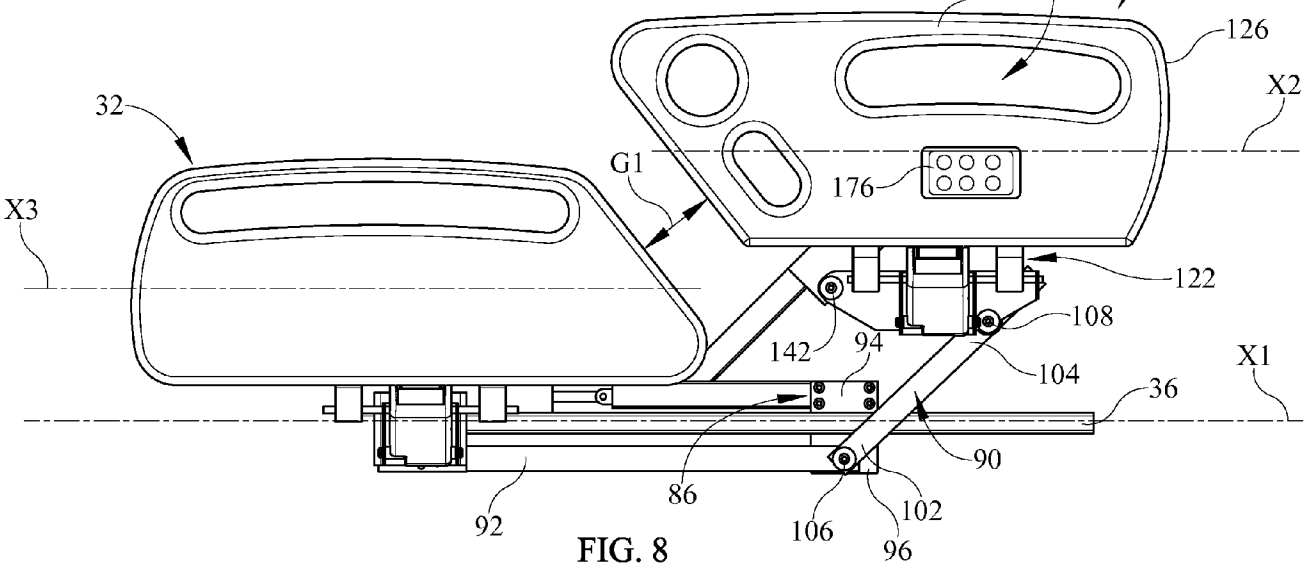
FIG. 8 is a side view of the person-support apparatus of FIG. 1, showing the headrail assembly cooperating with the footrail assembly to maintain the space as the first portion moves between the first position and the second position.
Figure 10:
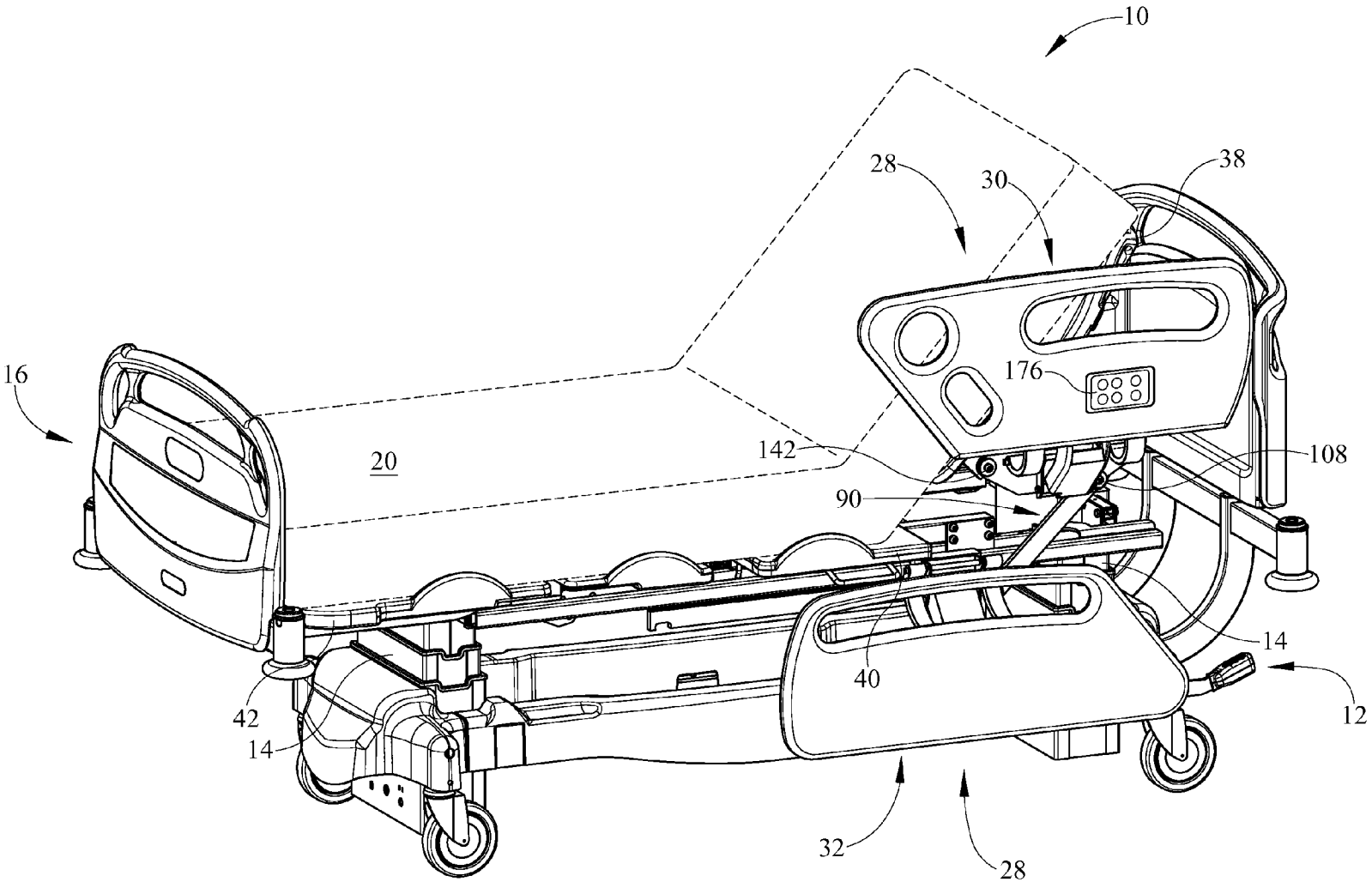
FIG. 10 is a perspective side view of the person-support apparatus of FIG. 1 showing the footrail positioned below the headrail.

The footrail base 150 can include a first footrail base portion 166 configured to be movably coupled to the second guide 36, and a second footrail base portion 168 coupled to the footrail link 92 at the second footrail link joint 116 as shown in FIG. 6. In one illustrative embodiment, the footrail link 92 can be coupled to the footrail base 150 and can move the footrail assembly 32 between a first position and a second position as a function of the movement of the head portion 38 of the deck 24. In another illustrative embodiment, the footrail link 92 can be decoupled from the footrail base 150 so that the footrail assembly 32 can be moved between a third position and a fourth position independently of the movement of the head portion 38. It should be appreciated that the third position and the fourth position can be the same as the first position and the second position. It should also be appreciated that the footrail base 150 can be positioned adjacent to the foot portion 42 in the third position and can be positioned adjacent to the head portion 38 and below the headrail assembly 30 in the fourth position as shown in FIG. 10.

The first footrail base portion 166 can include a slot 170 that can be configured to engage the second guide 36 and allow the footrail assembly 32 to slide along the second guide 36. It should be appreciated that the footrail base 150 can include wheels (not shown) configured to engage the second guide 36. The second footrail base portion 168 can include a coupling member 172, such as, for example, a peg or pin, that can extend from the footrail base 150 and can be engaged by the footrail link 92.

Figure 9:
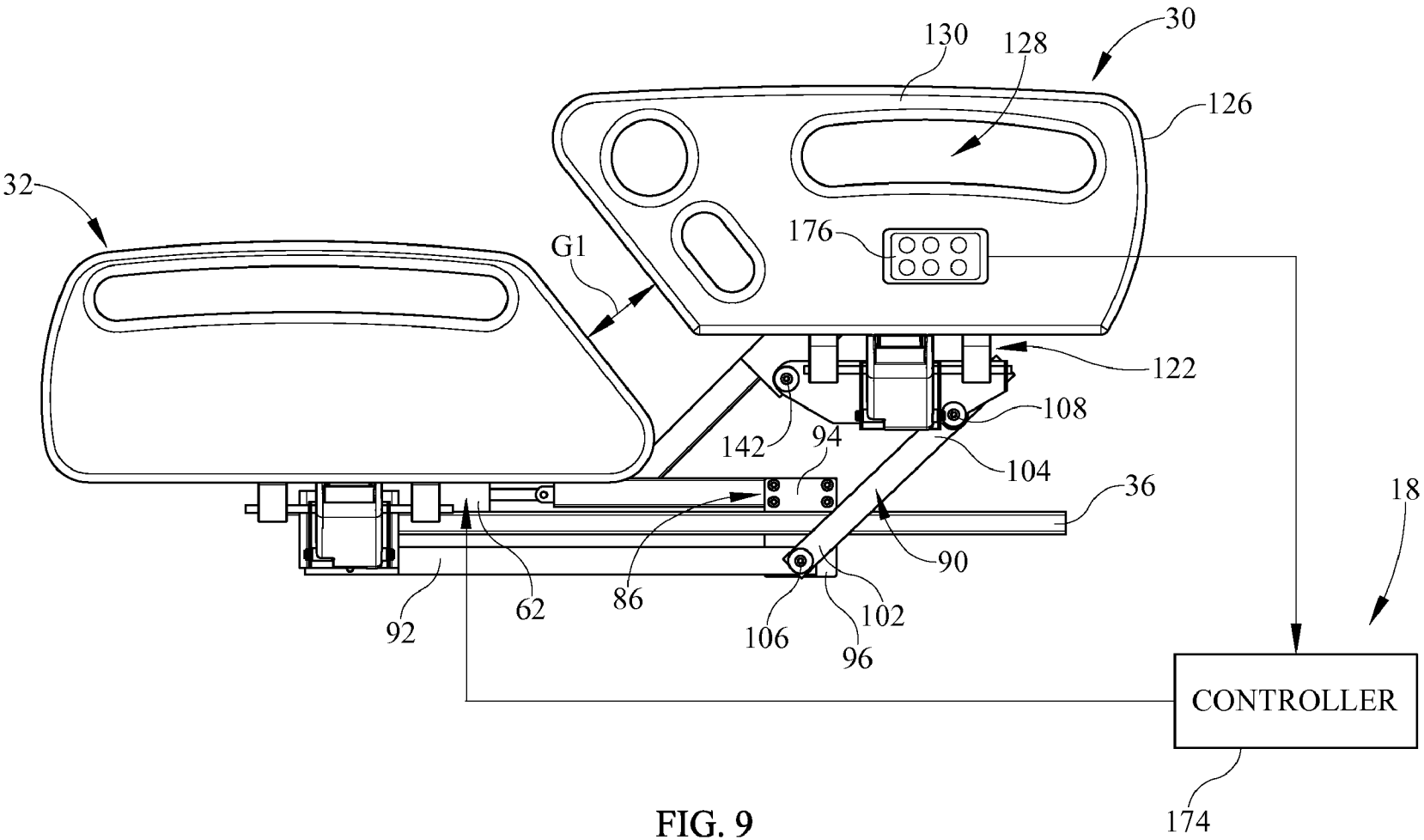
FIG. 9 is a diagrammatic view of the control system of the person-support apparatus of FIG. 1, showing the control system coupled to the user interface and an actuator.

The control system 18 can include a controller 174 and a user interface 176. The user interface 176 can be coupled to the siderails 28 and can be configured to receive an input from a person as shown in FIG. 9. The controller 174 can be configured to control at least one function of the person-support apparatus 10 in response to the input from the user interface. In one illustrative embodiment, the controller 174 can be configured to control the operation of the actuator 62 as a function of the input from the user interface 176 to move the head deck frame 44 from a first substantially horizontal position to a second raised position In operation, the head portion 38 of the deck 24 is initially positioned in a substantially horizontal position with the headrail assembly 30 in a substantially horizontal orientation such that the second longitudinal axis X2 is substantially parallel to the first longitudinal axis X1. The controller 174 can receive an input from the user interface 176 corresponding to inclining the head portion 38 of the deck 24. The controller 174 can actuate the actuator 62, causing the plunger 70 to extend from the base 68 and push on the bracket 54 coupled to the base member 48 of the head deck frame 44. As the plunger 70 pushes on the bracket 54, the slide 66 can move along the first guide 34 from a first slide position to a second slide position to translate the base member 48 along the first longitudinal axis X1 and the rotating links 64 can rotate about the rotational axis R1 with respect to the upper frame base 22 and about the rotational axis R2 with respect to the longitudinal members 50. The movement of the slide 66 along the first guide 34 and the rotation of the rotating links 64 can cause the head deck frame 44 to rotate about the rotational axis R3 and increase the angle of inclination of the head portion 38 of the deck 24 with respect to the upper frame base 22. As the slide 66 moves along the first guide 34, the extension plate 86 and extension member 88 can move with the slide 66 and pull the footrail link 92 to move the footrail assembly 32 along the second guide 36 and cooperate with the headrail link 90, headrail assembly 30, and head deck frame 44 to maintain the angular orientation of the headrail assembly 30 with respect to the upper frame 16 such that the second longitudinal axis X2 is substantially parallel to the first longitudinal axis X1.

Also, in operation, the footrail link 92 can be decoupled from the footrail base 150 and the footrail assembly 32 can be manually moved between a third position and a fourth position independently of the movement of the head portion 38. In the third position, the footrail base 150 can be positioned adjacent to the foot portion 42. It should be appreciated that the footrail body 146 can be in the deployed position or the storage position in the third position. In the fourth position the footrail body 146 is moved to the storage position and the footrail base 150 is positioned adjacent to the head portion 38 and below the headrail assembly 30.

Many other embodiments of the present disclosure are also envisioned. For example, a person-support apparatus comprises a frame, a first siderail; and a second siderail. The frame includes a first support section and a second support section. The first support section is configured to pivot between a first support position and a second support position with respect to the second support section. The first siderail is coupled to the first support section and configured to move therewith. The second siderail is coupled to the frame and is configured to move along the frame between a first position and a second position. The second siderail is configured to be positioned adjacent to the second support section in the first position, and adjacent to the first support section and below the first siderail in the second position.

In another example, a person-support apparatus comprises a frame, a guide, and a siderail. The frame includes a first section and a second section and defines a longitudinal axis that passes through the first section and the second section. The first section is configured to pivot between a first position and a second position about a rotational axis substantially perpendicular to the longitudinal axis. The guide is coupled to the frame and extends longitudinally there along. The guide is adjacent to the first section and the second section. The siderail assembly is configured to be movably coupled to the guide and configured to move along the guide between a first position and a second position independent of the movement of the first section. The siderail assembly is positionable adjacent the second section in the first position and positionable adjacent the first section in the second position.

In yet another example, a person-support apparatus comprises a frame, a guide, and a siderail. The frame includes a first section and a second section and defines a longitudinal axis that passes through the first section and the second section. The first section is configured to pivot about a rotational axis substantially perpendicular to the longitudinal axis between a first position and a second position. The guide is coupled to the frame and extends longitudinally there along. The siderail is configured to be moved between a deployed position where a portion of the siderail is positioned above the frame and a storage position where the portion is positioned below the deployed position. The siderail is movably coupled to the guide and configured to move along the guide between a first position and a second position. The siderail is configured to move between the deployed position and the storage position when adjacent to the second section in the first position and configured to be in only the storage position when adjacent to the first section in the second position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles could have been presented, they need not be utilized in combination, and various combinations of inventive aspects and principles are possible in light of the various embodiments provided above.

What is claimed is:

1. A person-support apparatus, comprising:

a frame including a first support section and a second support section, the first support section being configured to pivot between a first support position and a second support position with respect to the second support section;

a first siderail coupled to the first support section and configured to move therewith; and a second siderail coupled to the frame and configured to move along the frame between a first position and a second position independent of the movement of the first support section, the second siderail being configured to be positioned adjacent to the second support section in the first position, and adjacent to the first support section and below the first siderail in the second position.

2. The person-support apparatus of claim 1, wherein the second siderail is configured to be movable between a deployed position where a portion of the second siderail is above the frame and a storage position where the portion of the second siderail is below the deployed position, the second siderail being in the storage position when the second siderail is below the first siderail.

3. The person-support apparatus of claim 1, wherein the second siderail is configured to be moved along the frame between the first position and a third position as a function of the movement of the first support section.

4. The person-support apparatus of claim 3, wherein the second siderail is coupled to the first siderail by a linkage assembly that is configured to move the second siderail along the frame as a function of the movement of the first support section.

5. The person-support apparatus of claim 4, wherein the linkage assembly is configured to be decoupled from the second siderail to allow the second siderail to move independent of the first support section.

6. The person-support apparatus of claim 1, wherein the frame includes a guide member coupled thereto and extending longitudinally there along, the second siderail being movably coupled to the guide member and configured to move along the guide member between the first position and the second position.

7. The person-support apparatus of claim 1, wherein the second siderail is positioned below the first siderail when the first support section is in the second support position.

8. The person-support apparatus of claim 1, wherein the first siderail includes a first siderail axis passing therethrough representative of the orientation of the first siderail relative to the frame and the second siderail includes a second siderail axis passing therethrough representative of the orientation of the second siderail relative to the frame, the orientation of the first siderail axis and the second siderail axis remaining substantially the same with respect to the frame as the first support section moves between the first support position and the second support position.

9. The person-support apparatus of claim 1, wherein the first siderail includes a first siderail axis passing therethrough and the second siderail includes a second siderail axis passing therethrough, the first siderail axis and the second siderail axis being representative of the orientation of the first siderail and the second siderail relative to one another, the first siderail axis and the second siderail axis remaining in substantially the same orientation with respect to one another as the first support section moves between the first support position and the second support position.

10. A person-support apparatus, comprising:

a frame including a first section and a second section and defining a longitudinal axis that passes through the first section and the second section, the first section being configured to pivot between a first position and a second position about a rotational axis substantially perpendicular to the longitudinal axis;

a guide coupled to the frame and extending longitudinally there along, the guide being adjacent to the first section and the second section; and a siderail assembly configured to be movably coupled to the guide and configured to move along the guide between a first position and a second position independent of the movement of the first section, wherein the siderail assembly is positionable adjacent the second section in the first position and positionable adjacent the first section in the second position.

11. The person-support apparatus of claim 10, wherein the siderail is configured to move between a deployed position and a storage position in the first position and configured to be in only a storage position in the second position.

12. The person-support apparatus of claim 10 further comprising a second siderail coupled to the first section and configured to move therewith, the siderail being positionable below the second siderail in the second position.

13. The person-support apparatus of claim 12, wherein the siderail is in the storage position when positioned below the second siderail.

14. The person-support apparatus of claim 10, wherein the siderail is movable between a third position and a fourth position as a function of the movement of the first section.

15. The person-support apparatus of claim 14, wherein the siderail is coupled to the first section by a linkage assembly that is configured to move the siderail along the frame between the third position and the fourth position as a function of the movement of the first section.

16. The person-support apparatus of claim 15, wherein the linkage assembly is configured to be decoupled from the siderail to allow the siderail to move independent of the first section.

17. A person-support apparatus, comprising:

a frame including a first section and a second section and defining a longitudinal axis that passes through the first section and the second section, the first section being configured to pivot about a rotational axis substantially perpendicular to the longitudinal axis between a first position and a second position;

a guide coupled to the frame and extending longitudinally there along;

a siderail movably coupled to the guide and selectively couplable to the first section by a linkage assembly, the siderail being configured to be moved along the guide between a first position and a second position by the linkage assembly as the first section pivots between the first position and the second position, and being configured to move along the guide between a third position and a fourth position independent of the movement of the first section.

18. The person-support apparatus of claim 17 further comprising a second siderail coupled to the first section and configured to move with the first section as the first section rotates about the rotational axis between the first position and the second position, the siderail being positioned below the second siderail when the siderail is in the second position.

19. The person-support apparatus of claim 17, wherein the first position of the siderail is equal to the third position of the siderail.

20. The person-support apparatus of claim 17 further comprising a second siderail coupled to the first section and configured to move with the first section as the first section rotates about the rotational axis between the first position and the second position, the siderail cooperates with the second siderail to define a space therebetween, the siderail being configured to maintain the space between the siderail and the second siderail as the second siderail moves with the first section.

21. The person-support apparatus of claim 10 further comprising a second siderail assembly coupled to the first section and configured to move there with, wherein the second siderail assembly includes a second siderail axis passing there through representative of the orientation of the second siderail assembly relative to the frame and the siderail assembly includes a first siderail axis passing there through representative of the orientation of the siderail assembly relative to the frame, the orientation of the first siderail axis and the second siderail axis remaining substantially the same with respect to the frame as the first support section moves between the first position and the second position.

22. The person-support apparatus of claim 17 further comprising a second siderail coupled to the first section and configured to move there with, wherein the second siderail includes a second siderail axis passing there through representative of the orientation of the second siderail relative to the frame and the siderail includes a first siderail axis passing there through representative of the orientation of the siderail relative to the frame, the orientation of the first siderail axis and the second siderail axis remaining substantially the same with respect to the frame as the first section moves between the first position and the second position.

* * * * *